United States Patent [19]

Janes

[11] 4,061,123

[45] Dec. 6, 1977

[54] ENGINE DE-COMPRESSION MECHANISM

[76] Inventor: Robert W. Janes, 215 E. Page St., Orlando, Fla. 32806

[21] Appl. No.: 732,738

[22] Filed: Oct. 15, 1976

[51] Int. Cl.[2] ..... F02D 13/06

[52] U.S. Cl. ..... 123/198 F

[58] Field of Search ..... 123/198 F, DIG. 1, DIG. 6, 123/DIG. 7, DIG. 8, 1 R

[56] References Cited

U.S. PATENT DOCUMENTS

| | | | |
|---|---|---|---|
| 1,275,752 | 8/1918 | Roberto | 123/198 F |
| 1,985,447 | 12/1934 | Grubbs | 123/198 F |
| 2,019,252 | 10/1935 | Cottingham | 123/198 F |
| 2,098,115 | 11/1937 | Voorhies | 123/198 F |
| 2,948,274 | 8/1960 | Wood | 123/198 F |

*Primary Examiner*—Ronald H. Lazarus
*Assistant Examiner*—Ira S. Lazarus
*Attorney, Agent, or Firm*—Blair & Brown

[57] ABSTRACT

An engine de-compression mechanism in which the valves to one or more of the cylinders are locked in open position to prevent fuel from being drawn into the engine cylinder during the normal intake stroke and to prevent compression back pressure on the piston during the compression stroke. The function of the de-compression mechanism is to put one or more of the cylinders of the engine out of operation to conserve fuel when driving at high speeds.

3 Claims, 8 Drawing Figures

ENGINE DE-COMPRESSION MECHANISM

BACKGROUND OF THE INVENTION

Field of the Invention

The present invention relates to an engine de-compression mechanism for placing one or more cylinders out of operation.

SUMMARY OF THE INVENTION

The present invention relates to a de-compression mechanism for deactivating one or more of the cylinders of the engine by temporarily locking the valve leading to that particular cylinder in open position to permit the piston to move freely in the cylinder without producing a vacuum or a pressure. The lock includes a detent which engages in a peripheral groove in the valve lifter to prevent the valve lifter from moving inwardly on the cam shaft on rotation of the cam shaft.

The primary object of the invention is to provide a means of deactivating one or more cylinders of an engine to conserve fuel at high speeds.

Other objects and advantages will become apparent in the following specification when considered in light of the attached drawings.

DESCRIPTION OF THE PREFERRED EMBODIMENTS

Figure 1:
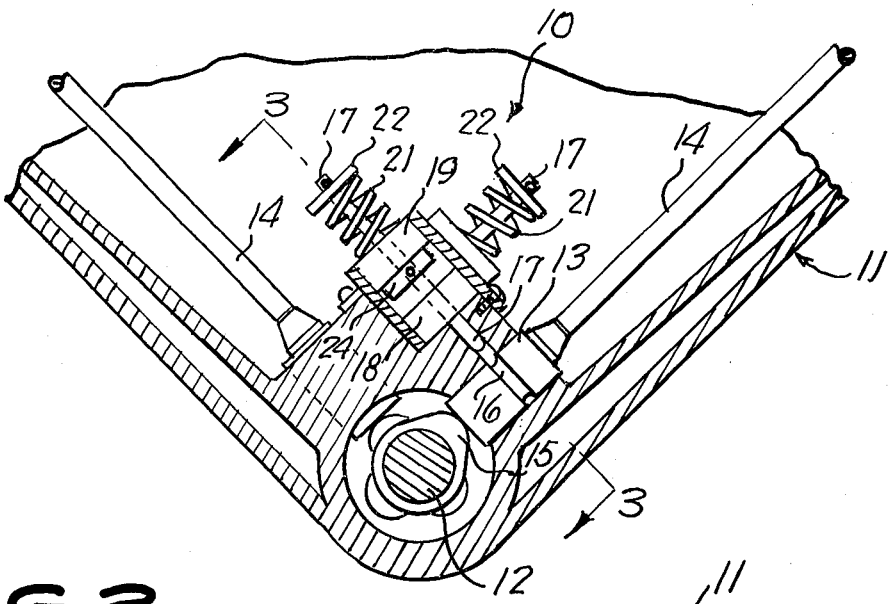
FIG. 1 is a front elevation of the invention shown installed in an engine fragmentarily shown and partially in section for convenience of illustration.

Referring now to the drawings in detail, wherein like reference characters indicate like parts throughout the several figures, the reference numeral 10 indicates generally an engine cylinder de-compression unit constructed in accordance with the invention.

The unit 10 is adapted for use with an engine generally indicated at 11 having a conventional cam shaft 12 extending therethrough. A valve lifter 13 is mounted in the engine 11 and normally engages the cam shaft 12 to be reciprocated thereby to move the valve push rods 14 upwardly when the cam lobe 15 is in contact with the valve lifter 13.

Figure 2:
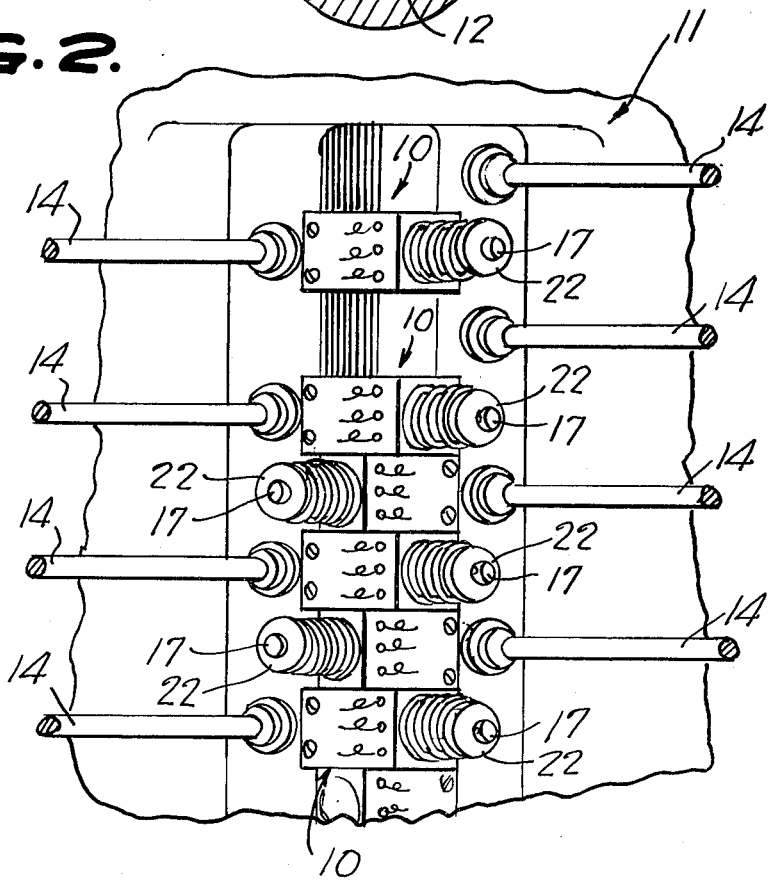
FIG. 2 is a top plan view of the structure illustrated in FIG. 1 with parts broken away for convenience of illustration.
Figure 3:
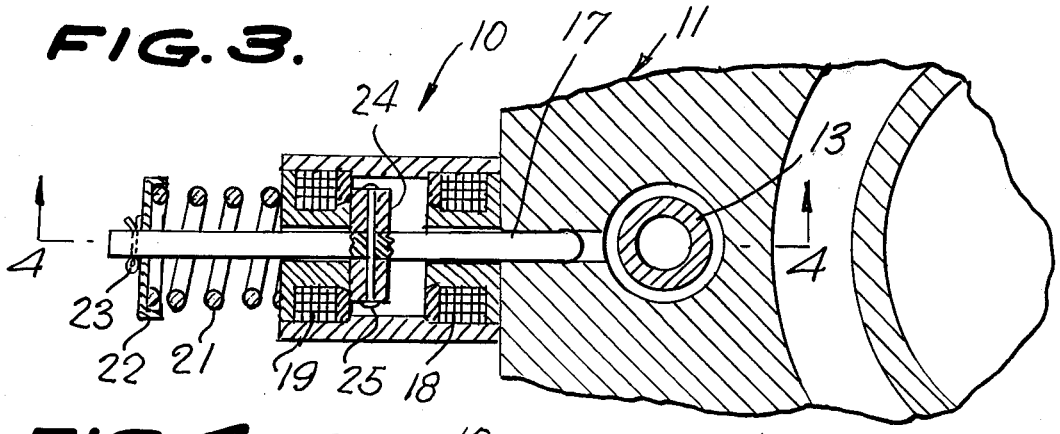
FIG. 3 is an enlarged fragmentary sectional view taken along the line 3—3 of FIG. 1, looking in the direction of the arrows.
Figure 4:
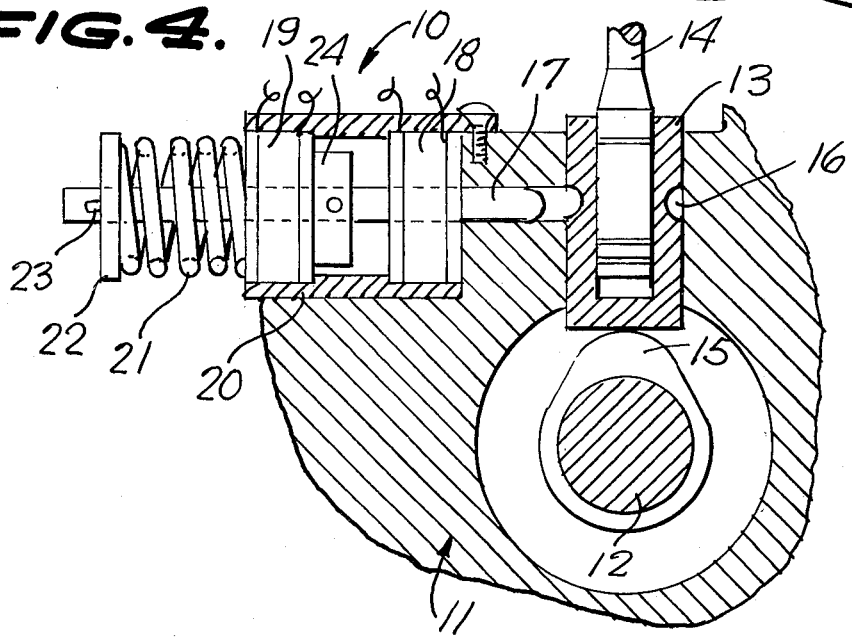
FIG. 4 is a transverse sectional view taken along the line 4—4 of FIG. 3, looking in the direction of the arrows.
Figure 5:
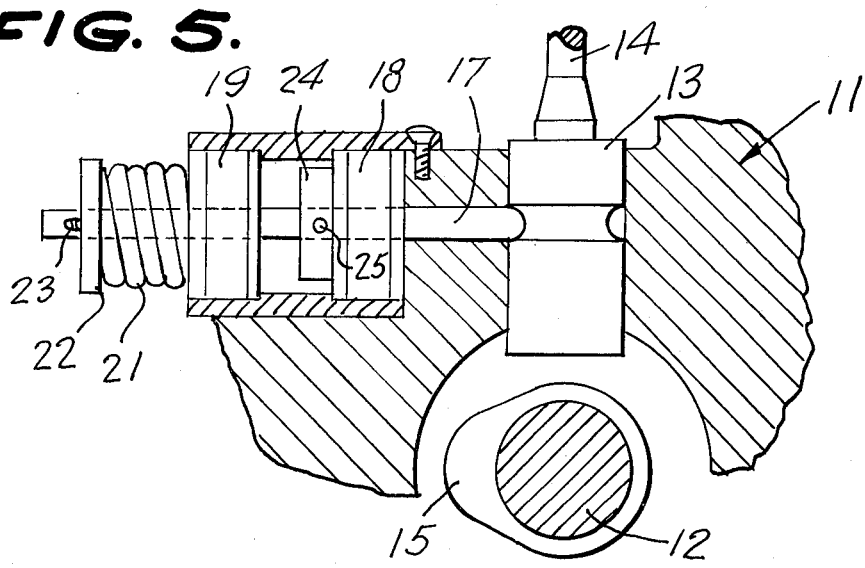
FIG. 5 is a view similar to FIG. 4 with the cam shaft rotated away from the locked valve lifter.

Each of the valve lifters 13 is provided with an annular groove 16 intermediate the opposite ends thereof and adapted to receive a detent pin 17 to lock the valve lifter 13 in its valve lifting position as illustrated in FIGS. 4 and 5. The detent shaft 17 extends through a magnetic coil 18 and a second magnetic coil 19 spaced therefrom both contained in a housing 20 mounted in the engine 11. A coil spring 21 engages a spring retainer cap 22 at the outer end of the detent shaft 17 and is secured thereto by a cotter key 23. A magnetizeable iron collar 24 is secured to the detent shaft 17 intermediate the magnetic coils 18, 19 so as to be drawn to the magnetic coil 18 or 19 when respectively energized. The spring 21 normally urges the detent shaft out of engagement with the groove 16 when neither of the coils 18, 19 are energized or fail for any reasons. The collar 24 is secured to the detent shaft 17 by an elongate pin 25. In FIG. 2 it can be seen that some of the push rods 14 are associated with the units 10 so that they can be selectively deactivated while some of the push rods 14 are not provided with units 10 and hence can not be deactivated.

In an engine of a vehicle traveling at relatively high speeds the speed of the vehicle can be maintained with only a portion of the engine actively providing power. With the present invention certain of the cylinders of the engine can be deactivated while the remaining cylinders remain active to produce power sufficient to maintain the car at its relatively high speed, thus, saving considerably on fuel consumption.

Controls (not shown) may be provided on the dashboard of the vehicle to permit the driver to selectively deactivate desired cylinders or if desired automatic means may be provided for deactivating the cylinders when not required to maintain the speed of the vehicle.

Figure 6:
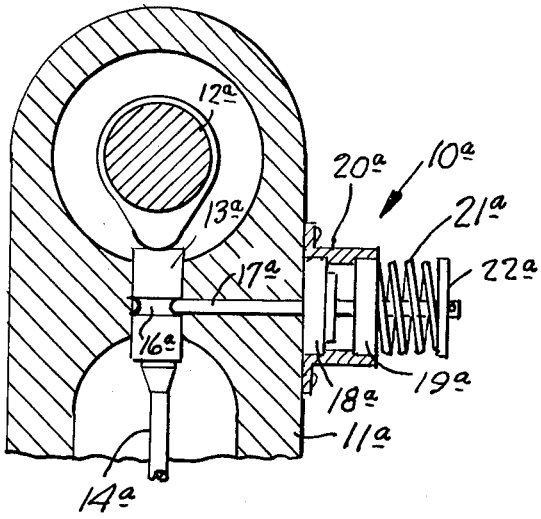
FIG. 6 is a fragmentary sectional view of the invention applied to an overhead valve engine.
Figure 7:
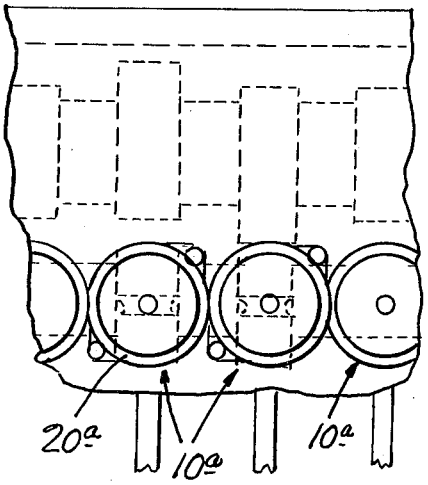
FIG. 7 is a side elevation shown partially broken away of the structure illustrated in FIG. 6.
Figure 8:
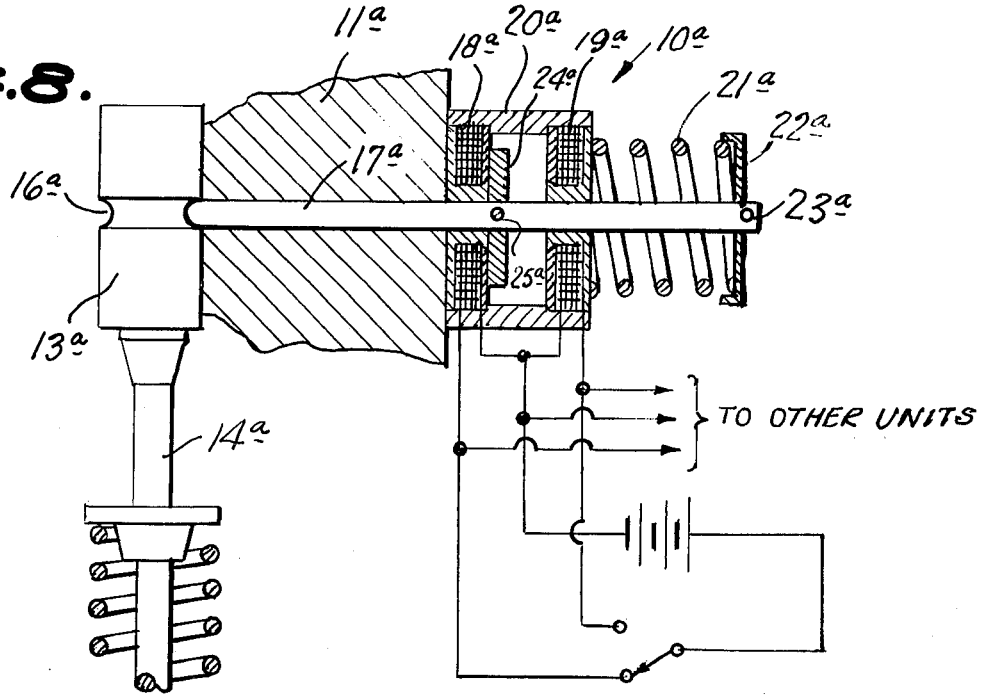
FIG. 8 is a sectional view of the structure illustrated in FIG. 6 showing details of the magnetic elements and the circuitry associated therewith.

In FIGS. 6 through 8 a slightly modified adaptation of the invention is illustrated adapting the invention to an overhead cam situation. In FIGS. 6 through 8 a de-compression unit **10*a* is attached to a head 11*a* of an overhead cam engine having a cam 12*a* mounted for rotation therein. A valve lifter 13*a* is mounted in the head 11*a* and is associated with a push rod 14*a* extending to a valve (not shown). An annular groove 16*a* is formed in the valve lifter 13*a* to receive one end of a detent shaft 17*a* which is adapted to engage therein to lock the valve lifter 13*a* in a valve raised position. A housing 20*a* is secured to the head 11*a* and has a pair of spaced apart magnetic coils 18*a*, 19*a* mounted therein with the shaft 17*a* extending therethrough. A coil spring 21*a* surrounds the detent shaft 17*a* and is held thereon by a spring cap 22*a* secured by a cotter key 23*a*. A magnetizeable iron collar 24*a* is secured to the detent shaft 17*a* by a pin 25*a* intermediate the magnetic coils 18*a*, 19*a***.

The use and operation of the invention illustrated in FIGS. 6 through 8 is identical to that of the preferred form of the invention illustrated in FIGS. 1 through 5.

Having thus described the preferred embodiments of the invention it should be understood that numerous structural modifications and adaptations may be resorted to without departing from the spirit of the invention.

What is claimed is:

1. A valve deactivator for de-compressing selected cylinders of an internal combustion engine of the type including a cam shaft and valve lifters comprising an annular detent groove formed in the valve lifters, a reciprocatable detent shaft engageable in the groove to lock the valve lifter in valve lifted position thereby removing said lifters from said cam shaft, means for moving said detent shaft from valve lifter unlocking position to valve lifter locking position and back again, and spring means for further disengaging said detent shaft from said groove in said valve lifter upon inaction of the means for moving said detent shaft.

2. A device as claimed in claim 1 wherein the means for moving said detent shaft comprises a pair of magnetic coils arranged in spaced apart relation around said shaft, and a magnetizeable collar secured to said shaft intermediate said coils to provide positive fail safe translation of said reciprocatable detent shaft from a naturally disengaged position to a locked position and back again.

3. A device as claimed in claim 1 wherein the engine is a valve in head engine.

* * * * *